US005451838A

United States Patent [19]

Kawai

[11] Patent Number: 5,451,838

[45] Date of Patent: Sep. 19, 1995

[54] METAL HALIDE LAMP

[75] Inventor: Kouji Kawai, Hamamatsu, Japan

[73] Assignee: Hamamatsu Photonics K.K., Hamamatsu, Japan

[21] Appl. No.: 205,117

[22] Filed: Mar. 3, 1994

[51] Int. Cl.[6] ..... H01J 61/20; H01J 61/22

[52] U.S. Cl. ..... 313/638; 313/640; 313/641; 313/571

[58] Field of Search ..... 313/638, 640, 641, 571

[56] References Cited

U.S. PATENT DOCUMENTS

| | | | |
|---|---|---|---|
| 4,647,814 | 3/1987 | Dobrusskin et al. | 313/641 |
| 4,686,419 | 8/1987 | Block et al. | 313/641 |
| 4,978,884 | 12/1990 | Van Vliet et al. | 313/641 X |
| 5,264,760 | 11/1993 | Genz et al. | 313/641 |
| 5,323,085 | 6/1994 | Genz | 313/641 X |

FOREIGN PATENT DOCUMENTS

| | | | |
|---|---|---|---|
| 0169510 | 1/1986 | European Pat. Off. . | |
| 0477668 | 4/1992 | European Pat. Off. . | |
| 2422411 | 12/1975 | Germany | 313/641 |
| 3512757 | 10/1986 | Germany . | |
| 47-36565 | 11/1972 | Japan . | |
| 55-32338 | 3/1980 | Japan . | |
| 0032338 | 5/1980 | Japan . | |
| 362444 | 3/1991 | Japan . | |
| 2209623 | 5/1989 | United Kingdom | 313/641 |

*Primary Examiner*—Sandra L. O'Shea
*Assistant Examiner*—Ashok Patel
*Attorney, Agent, or Firm*—Cushman Darby & Cushman

[57] ABSTRACT

A metal halide lamp includes a quartz sealed tube having a pair of electrodes using tungsten as the base material. Argon gas, mercury, at least one kind of rare earth metal (e.g., dysprosium, holmium, thulium, neodymium, and erbium), bromine, iodine, and an alkali metal, e.g., cesium, are contained in the sealed tube. The total number of moles of bromine and iodine in the sealed tube is in excess of the number of moles of the rare earth metal. Accordingly, tungsten which is liberated from the electrode during electric discharge can be captured mainly by iodine. A reaction between silicon dioxide, which is a constituent component of the sealed tube, and tungsten is prevented, thereby preventing blackening of the tube wall of the sealed tube.

13 Claims, 3 Drawing Sheets

METAL HALIDE LAMP

BACKGROUND OF THE INVENTION

1. Field of the Invention

The present invention generally relates to a metal halide lamp and, more particularly, to contents which are contained in a hermetically sealed tube of a metal halide lamp.

2. Related Background Art

A metal halide lamp is a lamp in which a metal halide is added in a sealed tube, in which mercury vapor is contained at a high pressure, to improve the luminous efficacy and color rending properties, and is widely used for general illumination. A conventional metal halide lamp is fabricated by charging, in a light-transmitting quartz tube, an inert gas, e.g., argon (Ar), at least one kind of halide ($LnX_2$ or $LnX_3$: where Ln is a rare earth metal, e.g., scandium (Sc), yttrium (Y), lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), or lutetium (Lu), and X is bromine (Br) or iodine (I)), mercury (Hg)), and an iodide (NAI: where NA is an alkali metal, e.g., sodium (Na), lithium (Li), cesium (Cs), potassium (K), or rubidium (Rb)) and sealing the tube. It should be noted that bromine or iodine, the rare earth metal and the alkali metal will be generally represented by symbols "X", "Ln" and "NA", respectively, hereinafter and the attached drawings.

In the above conventional metal halide lamp, tungsten (W) as the base material of electrodes is liberated by sputtering during use, and free tungsten reacts with silicon dioxide ($SiO_2$) as a constituent component of the sealed tube to deposit on the inner wall surface of the sealed tube, thereby blackening the tube wall within a short period of time. Blackening of the tube wall decreases the luminous efficacy and lumen maintenance factor. When the lumen maintenance factor decreases to about 70%, the metal halide lamp becomes inappropriate for practical use.

To solve this problem, a means of adding bromine in the sealed tube so that bromine is in excess of the rare earth metal is proposed (Japanese Patent Laid-Open No. 55-32338). According to this means, an excess of bromine reacts with free tungsten during electric discharge to form a compound ($WBr_2$ and $WBr_3$), thereby suppressing reaction of silicon dioxide of the sealed tube with tungsten. However, since bromine also reacts with mercury, free tungsten remains, which will likely be deposited on the inner wall surface of the sealed tube. Thus, the sealed tube is blackened within a comparatively short period of time even if an excess of bromine is added.

SUMMARY OF THE INVENTION

The present invention has been made in view of the above situation, and the object of the present invention is to provide a long-life metal halide lamp which prevents blackening of the tube wall.

According to the present invention, the above object is achieved by a metal halide lamp comprising a sealed tube, a pair of electrodes made of tungsten as a base material and arranged to oppose each other in the sealed tube, with the contents of the sealed tube including an inert gas, mercury, a rare earth metal, bromine, and iodine, wherein the total number of moles of bromine and iodine is in excess of the number of moles of the rare earth metal.

When two or more kinds of rare earth metals are contained in the sealed tube, the total number of moles of bromine and iodine must be in excess of the total number of moles of the rare earth metals.

"Excess" here means that when bromine and iodine react with all the rare earth metals, bromine or iodine that does not react with the rare earth metals remains. Accordingly, even when tungsten is emitted from the electrodes during electric discharge, it can be captured by iodine or bromine.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
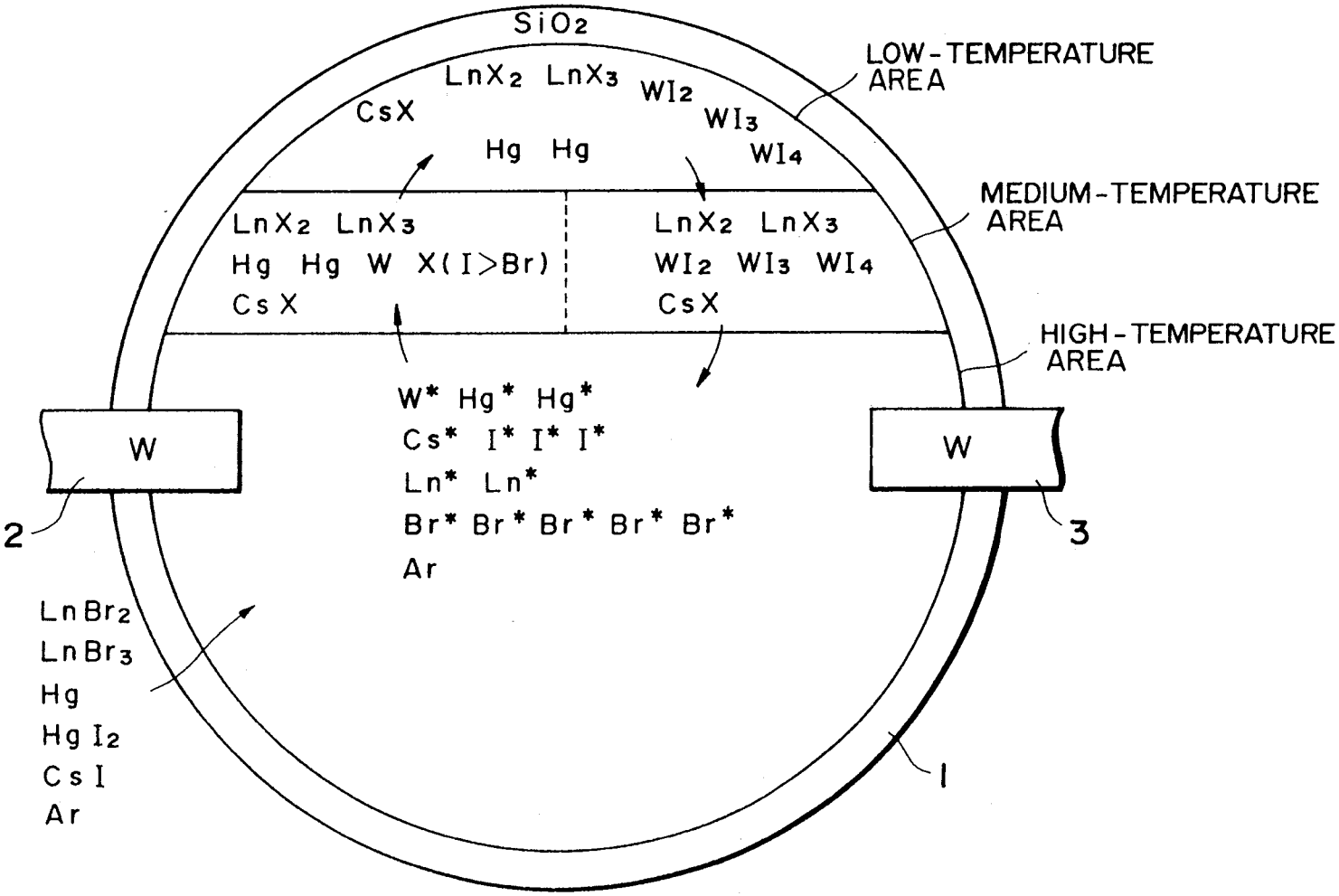
FIG. 1 is a view showing the principle of function of a metal halide lamp according to the present invention.

FIG. 1 is a view of a metal halide lamp according to an embodiment of the present invention, and shows the principle of function of the present invention. This metal halide lamp has a transparent quartz sealed tube and a pair of electrodes using tungsten as the base material. The respective electrodes are mounted on the sealed tube with hermetically passing through the wall surface of the sealed tube. The inner end portions of these electrodes are opposed to each other.

Argon (Ar), a rare earth metal (Ln), mercury (Hg), cesium (Cs), iodine (I), and bromine (Br) are contained in the sealed tube. In the manufacture of the lamp, these contents are charged in the tube in the form of atoms or compounds. More specifically, bromides of the rare earth metal ($LnBr_2$ and $LnBr_3$), mercury iodide ($HgI_2$), cesium iodide (CsI), argon gas, and mercury are charged in the tube during the manufacture. Regarding the amounts of these contents, the amounts of bromine and iodine are in excess of the amount of rare earth metals.

The inventors of the present invention assume that, in this circumstance, the following change in state takes place. Referring to FIG. 1, when arc discharge is started between a pair of opposed electrodes 2 and 3 which are made of tungsten as the base material, mainly in a high-temperature (2,000° C. or more) area near the electrodes 2 and 3, most of the contents are ionized. Tungsten of the electrodes 2 and 3 is also emitted from the electrodes 2 and 3 by sputtering and is ionized.

Subsequently, mainly in a medium-temperature (a range of 1,000° C. or more to less than 2,000° C.) area, bromine or iodine are recombined with cesium, and bromine or iodine are also recombined with rare earth metal. Further, mercury and tungsten are set in the atomic state. The excesses of bromine and iodine which are not recombined with the rare earth metal and cesium are also set in the atomic state. Since bromine has a higher reactivity than iodine, bromine is combined with cesium and rare earth metal before iodine is combined therewith. Therefore, in this medium-temperature area, most of the halogens in the atomic state are iodine.

Furthermore, in a low-temperature (a range of 800° C. or more to less than 1,000° C.) area near the wall surface of the sealed tube, tungsten tends to be combined with iodine. Unlike bromine, even when iodine is combined with mercury, it is quickly separated from mercury. When the amounts of free tungsten and iodine are sufficient with respect to each other, all tungsten atoms are captured by halogens, mainly iodine. Therefore, tungsten will not react with silicon dioxide which is an element constituting the sealed tube. Thereafter, the materials produced in the low-temperature area are circulated in a cycle indicated by arrows due to heat convection.

Tungsten iodides ($WI_2$, $WI_3$ and $WI_4$) and halides of rare earth metal ($LnX_2$ and $LnX_3$) formed in the low-temperature area react with silicon dioxide of the tube wall. However, since these products do not highly react with silicon dioxide, a long period of time is required until the tube wall is blackened to such a degree that the sealed tube is inappropriate for practical use. In this manner, when the excesses of bromine and iodine with respect to the rare earth metal are charged, free tungsten can be captured mainly by iodine and set in the halogen cycle, so that the effect of suppressing blackening of the tube wall is much enhanced.

A preferable condition of "excess" described above is expressed by a relation of numbers of moles as follows:

$$\{M(Br)+M(I)\}/M(Ln)>3 \quad (1)$$

where M(Br) is the number of moles of bromine atoms, M(I) is the number of moles of iodine atoms, and M(Ln) is the number of moles of rare earth metal atoms.

When an alkali metal, e.g., cesium, is contained in the sealed tube, since the alkali metal is combined easily with bromine or iodine rather than with a rare earth metal, the number of moles of the alkali metal must be subtracted in advance. Accordingly, if an alkali metal is contained, the above condition can be rewritten as follows:

$$\{M(Br)+M(I)-M(NA)\}/M(Ln)>3 \quad (2)$$

where M(NA) is the number of moles of alkali metal atoms.

Since it is known that a halide ($LnBr_aI_b$) of a rare earth metal with bromine and/or iodine stoichiometrically forms a bivalent or trivalent halide, it is apparent that $2 \leqq a+b \leqq 3$. Accordingly, if $M(Br)/M(Ln)<1$, that is, if $a<1$, the chemical properties of the halide of the rare earth metal become close to those of $LnI_2$ or $LnI_3$.

Figure 2:
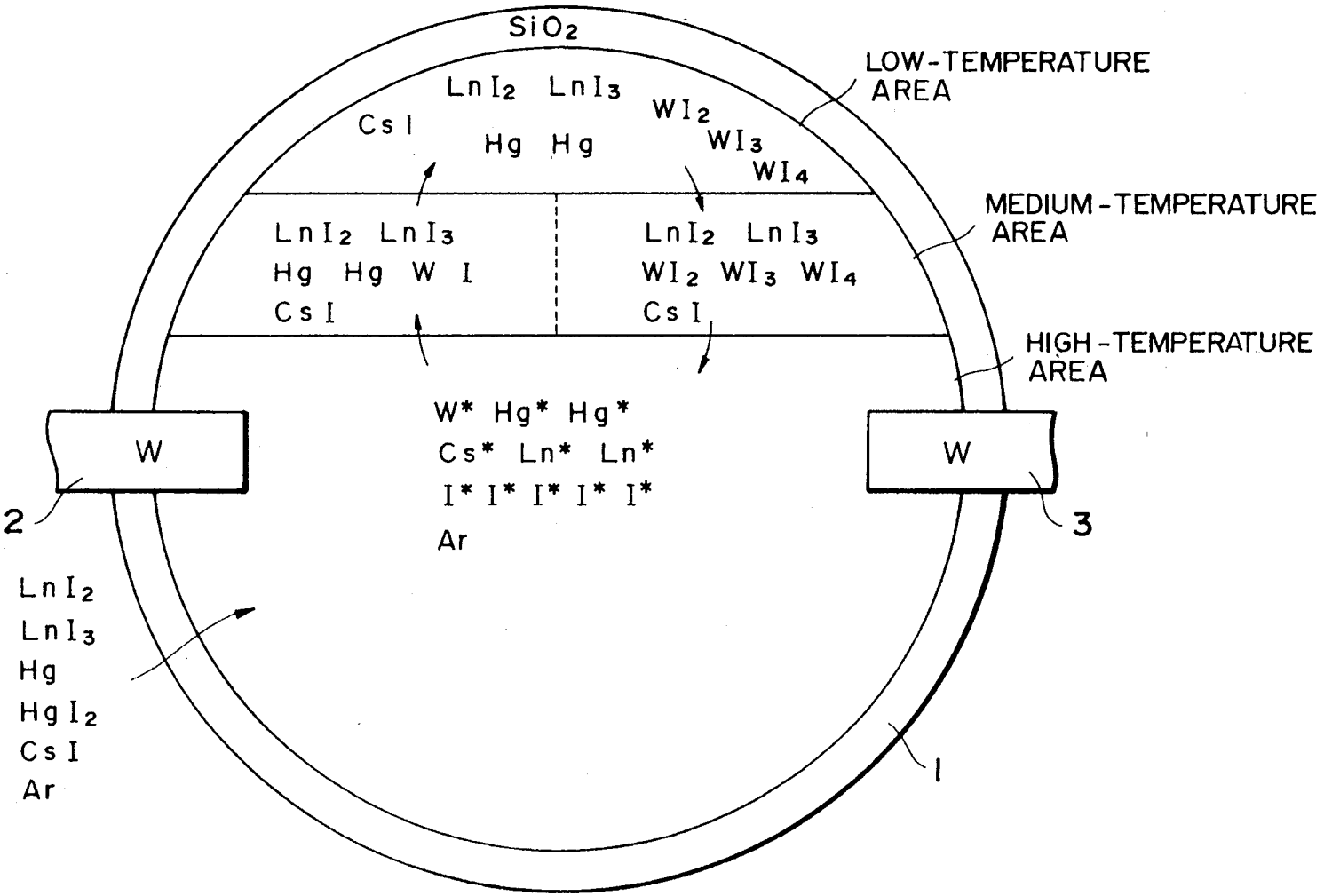
FIG. 2 is a view showing the principle of function of a metal halide lamp in which, among halogens, only iodine is contained.

FIG. 2 is a view showing the principle of a case wherein bromine is not added at all and only an excess of iodine is charged in a sealed tube. In the low-temperature area, iodine is combined with the rare earth metal, cesium and tungsten. However, since the iodide of the rare earth metal is combined less than the bromide of the rare earth metal, substitution reaction of the rare earth metal with silicon dioxide of the sealed tube often occurs. Hence, the rare earth metal tends to deposit on the inner wall surface of the sealed tube, thereby decreasing the service life when compared to a case wherein bromine is contained in the sealed tube. Accordingly, in order to prevent blackening of the tube wall, it is required to satisfy:

$$M(Br)/M(Ln) \geqq 1 \quad (3)$$

The upper limit of the above value is preferably 3 from the results of various experiments. More specifically, $$3 \geqq M(Br)/M(Ln) \geqq 1 \quad (4)$$

Examples of the present invention will be described.

In the examples of the present invention, a rugby-ball like spherical quartz sealed tube having a major axis of 25 mm, a minor axis of 21 mm, an internal volume of 3.2 cc, and an interelectrode distance of 7 mm was used. Argon gas was contained as an initiating inert gas, and the pressure in the sealed tube was set to 50 to 300 torr (6.65 to 39.9 kPa). The electrodes were made of tungsten as the base material. Cesium was contained to prevent flickering of the lamp. Of course, it is to be understood that the present invention is not intended to be limited to the above-mentioned size or pressure, etc.

Table 1 indicates the compositions, electrical characteristics, optical characteristics, and the like of the contents (excluding argon) of Examples 1 to 9 according to the present invention. In the respective examples, as shown in Table 1, two or more kinds of rare earth metals appropriately selected from dysprosium (Dy), holmium (Ho), thulium (Tm), neodymium (Nd) and erbium (Er); an alkali metal, i.e., cesium (Cs); iodine (I); bromine (Br); and mercury (Hg) were contained in the sealed tube to satisfy the relations (2) and (4). In the manufacture, the rare earth metals and the alkali metal were charged in the form of iodides or bromides in Examples 1 to 9.

In the following tables, the electrical characteristics indicate the initial value, and the lumen maintenance factor of the optical characteristics is a proportion of the value of the luminous flux at a lapse of a predetermined period of time with respect to the initial value of the luminous flux at the central area on the screen when light was projected from the metal halide lamp of each example which is mounted in an overhead projector. In the result of judgement, x represented a case wherein the lumen maintenance factor was less than 70% before the lapse of 48 hours since the start of light emission, Δ represented a case wherein the lumen maintenance factor was 70% or more at the lapse of 48 hours but was less than 70% at the lapse of 500 hours, ○ represented a case wherein the lumen maintenance factor was between 70% or more and less than 80% at the lapse of 500 hours, and ◎ represented a case wherein the lumen maintenance factor was 80% or more at the lapse of 500 hours.

TABLE 1

| Example | Sealed Material: Halides of Rare Earth Metal and Alkali Metal: Rare Earth Metal ($\times 10^{-6}$ mol) | Cs ($\times 10^{-6}$ mol) | Halogen ($\times 10^{-6}$ mol) | $HgBr_2$ Br ($\times 10^{-6}$ mol) | $HgI_2$ I ($\times 10^{-6}$ mol) | CsI Cs I ($\times 10^{-6}$ mol) | Hg (mg) | Maintenance: M(Br)/M(Ln) | {M(Br) + M(I) − M(NA)}/M(Ln) | Electrical Characteristics V(v) | I(A) | W(W) | Optical Characteristics: Color Temperature (K) | Lumen Factor (%) (Time Hr) | Judgement |
|---|---|---|---|---|---|---|---|---|---|---|---|---|---|---|---|
| 1 | Dy, Ho, Tm } 10.75 | 0.51 | I: 32.76 | 5.0 mg 27.75 | — | — | 50 | 2.58 | 5.58 | 111 | 5.3 | 588 | 5600 | 91 (1000) | ◎ |
| 2 | Dy, Ho, Tm } 12.55 | 0.59 | I: 38.22 | 5.0 mg 27.75 | — | — | 48 | 2.21 | 5.21 | 94 | 6.37 | 5.99 | 5500 | 89 (700) | ◎ |
| 3 | Nd, Dy } 9.58 | 3.28 | I: 32.02 | 5.0 mg 27.75 | — | — | 48 | 2.90 | 5.90 | 105 | 5.62 | 590 | 5800 | 90 (500) | ◎ ◎ |
| 4 | Er, Dy, Ho, Tm } 10.38 | 2.34b | I: 3.14 Br: 30.3 | — | 4.0 mg 17.6 | 0.5 mg Cs: 1.92 I: 1.92 | 48 | 2.92 | 4.69 | 91 | 6.50 | 592 | 6300 | 90 (500) | ◎ |
| 5 | Dy, Ho, Tm } 10.75 | 0.51 | I: 32.76 | 4.0 mg 22.2 | 0.4 mg 1.76 | — | 48 | 2.06 | 5.22 | 83 | 7.07 | 587 | 5519 | 85 (500) | ◎ |
| 6 | Dy, Ho, Tm } 10.75 | 0.51 | I: 32.76 | 3.4 mg 18.87 | 1.2 mg 5.28 | — | 48 | 1.76 | 5.25 | 85 | 6.89 | 583 | 5387 | 78 (500) | ∘ |
| 7 | Dy, Ho, Tm } 10.75 | 0.51 | I: 32.76 | 3.0 mg 16.65 | 1.6 mg 7.04 | — | 48 | 1.55 | 5.20 | 86 | 6.88 | 589 | 5168 | 72 (500) | ∘ |
| 8 | Dy, Ho, Tm } 10.75 | 0.51 | I: 32.76 | 2.4 mg 13.32 | 2.4 mg 10.56 | — | 48 | 1.24 | 5.22 | 85 | 6.84 | 583 | 5561 | 76 (48) | Δ |
| 9 | Dy, Ho, Tm } 10.75 | 0.51 | I: 32.76 | 2.0 mg 11.1 | 3.0 mg 13.2 | — | 48 | 1.03 | 5.26 | 82 | 7.03 | 579 | 5481 | 75 (48) | Δ |

As is understood from Table 1, it is apparent that in any of Examples 1 to 9, a high lumen maintenance factor was maintained over a long period of time, and blackening of the tube wall was prevented. Especially, in Example 1 wherein $10.75\times10^{-6}$ mole of rare earth metals (dysprosium, holmium, and thulium), $0.51\times10^{-6}$ mole of cesium, $32.76\times10^{-6}$ mole of iodine, and $27.75\times10^{-6}$ mole of bromine were contained in the sealed tube, the lumen maintenance factor was maintained at 90% over 1,000 hours and 85% after 1,630 hours, thereby obtaining an excellent result.

From these results, it is possible to take the view that the preferable condition is as follows:

$$3 \geqq M(Br)/M(Ln) \geqq 2, \text{ and}$$

$$\{M(Br)+M(I)-M(NA)\}/M(Ln) > 4.5$$

Also, we consider that the further preferable condition is as follows:

$$2.95 \geqq M(Br)/M(Ln) \geqq 2.2, \text{ and}$$

$$\{M(Br)+M(I)-M(NA)\}/M(Ln) > 4.6$$

However, in case that the rated power of the lamp is lower, the value of $[M(Br)+M(I)-M(NA)]/M(Ln)$ may be more than 3.

Samples 1 to 4 of Table 2 exhibit the performance of each metal halide lamp in which the composition of the contents does not satisfy conditions (2) and (4).

TABLE 2

| Example | Sealed Material: Halides of Rare Earth Metal and Alkali Metal: Rare Earth Metal ($\times 10^{-6}$ mol) | Cs ($\times 10^{-6}$ mol) | Halogen ($\times 10^{-6}$ mol) | $HgBr_2$ Br ($\times 10^{-6}$ mol) | $HgI_2$ I ($\times 10^{-6}$ mol) | CsI Cs I ($\times 10^{-6}$ mol) | Hg (mg) | Maintenance: M(Br)/M(Ln) | {M(Br) + M(I) − M(NA)}/M(Ln) | Electrical Characteristics V(v) | I(A) | W(W) | Optical Characteristics: Color Temperature (K) | Lumen Factor (%) (Time Hr) | Judgement |
|---|---|---|---|---|---|---|---|---|---|---|---|---|---|---|---|
| 1 | Dy, Ho, Tm } 9.54 | 2.00 | Br: 30.3 | 5.0 mg 27.75 | — | — | 48 | 6.14 | 5.93 | 102 | 5.71 | 582 | 6050 | 70 (300) | Δ |
| 2 | Dy, Ho, Tm } 10.75 | 0.51 | I: 32.76 | — | — | — | 55 | 0 | 3.00 | 107 | 5.49 | 587 | 6000 | 56 (46) | X |
| 3 | No, Ho, Tm } 10.75 | 0.51 | I: 32.76 | — | 6.0 mg 26.4 | — | 48 | 0 | 5.46 | 111 | 5.23 | 581 | 5100 | 69 (48) | X |
| 4 | Dy, Ho, Tm } 10.35 | 2.04 | I: 2.73 Br: 30.3 | — | — | — | 60 | 2.93 | 3.0 | 92 | 6.46 | 594 | 6600 | 65 (48) | X |

In Sample 1 of Table 2, iodine was not charged but only an excess of bromine with respect to the rare earth metals was charged. This sample corresponds to the means disclosed in Japanese Patent Laid-Open No. 55-32338. The lumen maintenance factor was 70% after 300 hours, and thus a comparatively good result was obtained. However, the remarkable effect as shown in Example 1 of the present invention was not obtained.

Samples 2 and 3 show cases of conventional metal halide lamps wherein experiments were conducted without charging bromine. Sample 4 shows a case of a metal halide lamp in which bromine was charged together with iodine. In Sample 4, however, the relationship between numbers of moles does not satisfy the above conditions. It is apparent that in these Samples 2 and 4 the lumen maintenance factors become less than 70% after 48 hours, so that blackening of the tube wall occurs in an early period.

Figure 3:
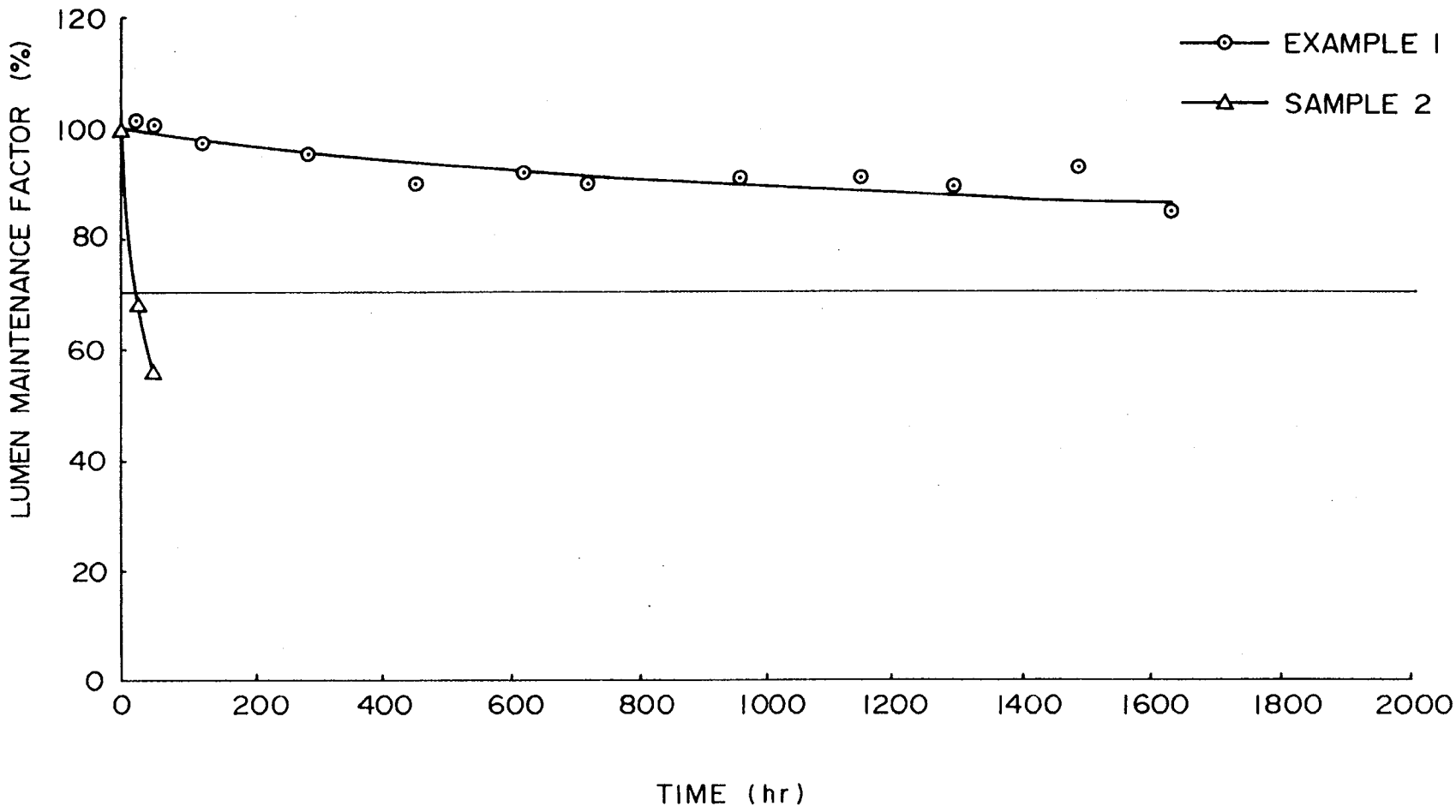
FIG. 3 is a graph showing the results of life test of the metal halide lamp according to the present invention and a conventional metal halide lamp.

It will be understood from comparison between Tables 1 and 2 that the performance of the metal halide lamp is remarkably improved according to the present invention. FIG. 3 is a graph showing service life data of Example 1 of the present invention and that of Sample 2. The excellence of the present invention can be clearly recognized from FIG. 3.

In the above embodiment, only iodine and bromine are sealed in the lamp as halogens. However, since fluorine (F) and chlorine (Cl) as the halogen elements have the same properties as those of bromine, one or both of fluorine and chlorine may be used in place of or together with bromine.

Similar effects are obtained in a ceramic sealed tube (mainly a light-transmitting alumina ($Al_2O_3$) tube) in place of the quartz ($SiO_2$) sealed tube, because the mechanism of blackening of the alumina tube and preventing it is substantially similar to the one for the quartz tube. Also, similar effects are obtained in a sealed tube which is made of a synthetic transparent glass material comprising quartz or alumina doped with a metal oxide, e.g., $ZrO_2$ or $TiO_2$.

Further, the sealed tube need not to be completely transparent but one, e.g., made of frosted glass, that can partly transmit light therethrough may be used instead.

The inert gas in the sealed tube is not limited to argon gas, but other gases, e.g., helium, neon, krypton, xenon, or radon gas, can be used.

As has been described above, according to the present invention, a remarkable effect can be obtained in which blackening of the tube wall of a metal halide lamp is prevented over a long period of time and the service life of the metal halide lamp is greatly prolonged.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A metal halide lamp comprising:

a sealed tube capable of transmitting light therethrough;

a pair of electrodes comprising tungsten as a base material and disposed parallel to each other within said sealed tube; and wherein said sealed tube contains a gas mixture including an inert gas, mercury, at least one species of rare earth metal, bromine, iodine, and at least one species of alkali metal, wherein the relationship of bromine and iodine with said species of rare earth metal and said species of alkali metal is $$3 \geqq M(Br)/M(Ln) \geqq 2, \text{ and}$$

$$\{M(Br)+M(I)-M(NA)\}/M(Ln)>4.5$$

where M(Br) is a number of moles of bromine atoms, M(I) is the number of moles of iodine atoms, M(NA) is the number of moles of said species of alkali metal atoms, and M(Ln) is the number of moles of said species of rare earth metal atoms.

2. A metal halide lamp according to claim 1, wherein said sealed tube comprises quartz.

3. A metal halide lamp according to claim 1, wherein said sealed tube comprises a ceramic.

4. A metal halide lamp according to claim 3, wherein said ceramic is alumina.

5. A metal halide lamp according to claim 1, wherein said sealed tube comprises a synthetic transparent glass material comprising quartz doped with a metal oxide.

6. A metal halide lamp according to claim 5, wherein said metal oxide is an element selected from the group consisting of $ZrO_2$ and $TiO_2$.

7. A metal halide lamp according to claim 1, wherein said sealed tube comprises a synthetic transparent glass material comprising alumina doped with a metal oxide.

8. A metal halide lamp according to claim 7, wherein said metal oxide is an element selected from the group consisting of $ZrO_2$ and $TiO_2$.

9. A metal halide lamp according to claim 1, wherein the inert gas is a gas selected from the group consisting of argon, helium, neon, krypton, xenon and radon gases.

10. A metal halide lamp according to claim 1, wherein the rare earth metal is at least one element selected from the group consisting of scandium, yttrium, lanthanum, cerium, praseodymium, neodymium, promethium, samarium, europium, gadolinium, terbium, dysprosium, holmium, erbium, thulium, ytterbium and lutetium.

11. A metal halide lamp according to claim 1, wherein the alkali metal is at least one element selected from the group consisting of lithium, sodium, potassium, rubidium and cesium.

12. A metal halide lamp according to claim 1, wherein the number of moles of bromine atoms, said species of rare earth metal atoms, and said species of alkali metal atoms satisfy the relationship:

$$2.95 \geqq M(Br)/M(Ln) \geqq 2.2, \text{ and}$$

$$\{M(Br)+M(I)-M(NA)\}/M(Ln)>4.6.$$

13. A metal halide lamp comprising:

a sealed tube adapted to transmit light therethrough;

a pair of electrodes, formed of a material including tungsten, disposed parallel to each other within said sealed tube;

wherein said sealed tube contains a gas mixture including:

an inert gas;

mercury;

at least one species of rare earth metal;

iodine;

a component including at least one element selected from the group consisting of fluorine, chlorine and bromine; and at least one species of alkali metals;

wherein the relationship between said component and iodine with said rare earth metal and said alkali metal being:

$$3 \geqq M(Com)/M(Ln) \geqq 2, \text{ and}$$

$$\{M(Com)+M(I)-M(NA)\}/M(Ln)>4.5$$

where M(Com) is a number of moles of said component atoms, M(I) is the number of moles of iodine atoms, M(NA) is the number of moles of said species of alkali metal atoms, and M(Ln) is the number of moles of said species of rare earth metal atoms.

* * * * *